US010060110B2

(12) United States Patent
Bugni et al.

(10) Patent No.: US 10,060,110 B2
(45) Date of Patent: Aug. 28, 2018

(54) DRILL POWERED DRAIN CLEARING TOOL

(71) Applicant: Dynadrain LLC, Cle Elum, WA (US)

(72) Inventors: Charles Dominic Bugni, Cle Elum, WA (US); Peter Anthony Bugni, Ellensburg, WA (US); John Augustine Bugni, Ellensburg, WA (US)

(73) Assignee: Dynadrain LLC, Cle Elum, WA (US)

( * ) Notice: Subject to any disclaimer, the term of this patent is extended or adjusted under 35 U.S.C. 154(b) by 328 days.

(21) Appl. No.: 14/544,585

(22) Filed: Jan. 26, 2015

(65) Prior Publication Data

US 2015/0247309 A1 Sep. 3, 2015

(51) Int. Cl.

| | |
|---|---|
| ***E03C 1/308*** | (2006.01) |
| ***E03D 9/00*** | (2006.01) |
| ***E03C 1/30*** | (2006.01) |

(52) U.S. Cl.

CPC ..... *E03C 1/308* (2013.01); *E03C 1/30* (2013.01); *E03D 9/00* (2013.01)

(58) Field of Classification Search

CPC . E03C 1/308; E03C 1/30; A47K 11/10; E03D 9/00; F04B 7/00; F04B 7/0057

See application file for complete search history.

(56) References Cited

U.S. PATENT DOCUMENTS

| | | | | | |
|---|---|---|---|---|---|
| 729,156 | A * | 5/1903 | Geiger | E03C 1/308 | 4/255.03 |
| 1,340,126 | A * | 5/1920 | Ustrzycki | E03C 1/308 | 285/405 |
| 3,934,280 | A * | 1/1976 | Tancredi | E03C 1/308 | 4/255.02 |
| 4,445,236 | A * | 5/1984 | Nadolny | E03C 1/308 | 4/255.01 |
| 5,353,442 | A * | 10/1994 | Rotter | E03C 1/308 | 4/255.11 |
| 5,380,175 | A * | 1/1995 | Amarume | F04B 5/02 | 347/85 |
| 5,423,621 | A * | 6/1995 | Russell | A46B 11/0013 | 15/160 |
| 5,974,596 | A * | 11/1999 | Strzok | E03C 1/308 | 4/255.11 |
| 6,193,482 | B1 * | 2/2001 | Chen | F04B 39/0016 | 417/545 |
| 2009/0211615 | A1 * | 8/2009 | Ho | B08B 3/12 | 134/56 R |
| 2014/0026307 | A1 * | 1/2014 | Washington, Jr. | E03F 9/005 | 4/255.01 |
| 2016/0017583 | A1 * | 1/2016 | Petner | E03C 1/308 | 4/255.11 |

* cited by examiner

*Primary Examiner* — Christopher Harmon

(74) *Attorney, Agent, or Firm* — Grandview Law PLLC

(57) ABSTRACT

A mechanized, light weight, and compact drain opener that is different and more effective than any present art device available, as it is easily portable, of low cost, and enables virtually anyone the ability to employ a powerful, easily operated, non-manual, thrusting and pumping action upon a clogged drain, by ability of the device to be easily placed immediate to a clogged drain, and powered by any common, inexpensive electric drill, commonly found in most homes, as opposed to existing art devices, that when portable, are generally manually operated, difficult to use, and only marginally effective, or when effective, are large, cumbersome, motor-driven devices, that are of a prohibitive cost to own, by the average person.

9 Claims, 7 Drawing Sheets

DRILL POWERED DRAIN CLEARING TOOL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

Field of Invention

The invention described herein relates to the field of devices designed to unplug, and clear plumbing drains of sinks, toilets, showers, or bathtubs obstructed by waste materials. More specifically, the invention relates to a means of unplugging obstructed drains using a portable device, powered by a non-manual, rotary motive force, to drive a piston device act upon fluid and an obstructing material within a drain, to dislodge that material.

Background of the Invention

Existing devices designed to clear or unplug obstructed plumbing drains consist of two general types: those producing either compression and/or suction forces upon the fluid and obstructive material present in the drain, to dislodge or break up the obstruction; and devices with a mechanical appendage designed to be inserted into a clogged drain to clear an obstruction by coming into direct mechanical contact with the obstruction, and either dislodging or breaking up an obstruction by direct mechanical action. Existing devices designed to unclog obstructed drains by means of producing either compression and/or suction forces upon the fluid and obstruction in a clogged drain, do so either by the introduction of additional fluid or gas under pressure created by an external, non-manual, motive force, or by means of manually operated pumps, pistons, or plungers. Some existing devices using direct mechanical contact with a drain obstruction to either dislodge or break up the obstruction, may also be powered either manually or by an external motive force.

In regard to those existing devices using direct mechanical contact to dislodge or break up a drain obstruction, the devices although effective, can be in the case of those powered by an external motive force, are generally either complicated, cumbersome, or relatively expensive enough to preclude their use by the ordinary person. While those existing devices, that are manually powered, that are utilized direct mechanical contact to dislodge or break up drain obstructions, although generally less expensive, are often either ineffective, or very inconvenient and messy for the ordinary person to use.

In a similar way existing, externally powered devices, using pumps, pistons, vacuums, or pump and vacuum combinations to dislodge or break up drain obstructions are also too complicated, cumbersome, or expensive for use by the ordinary person. Although simple, portable, and relatively inexpensive, and therefore affordable by the average home owner, manually powered existing devices, such as pumps, pistons, and plungers are limited in their effectiveness, because both amount of pressure and suction forces produced, and the duration of the application of those forces, owing to the limitations of human muscular strength and endurance.

The relative complexity and high of existing externally powered devices designed to unclog drains, that although effective in some instances, makes them an unattractive solution for unclogging obstructed drains for the average person. While relatively simple and inexpensive, existing manually operated devices designed to unclog obstructed drains are only marginally effective, and are physically difficult for the average person to use to successfully open a clogged drain. Therefore, a need exists for an externally powered and effective, yet low cost drain unclogging device for use by the average person.

Objects and Advantages

The objectives of the invention described in this patent are to provide an externally powered and motivated device, that is affordable for the average person, relatively simple to use, and effective in opening the most commonly occurring types of sink, toilet, shower, and bathtub drain obstructions and clogs. This device will provide the drain-opening effectiveness of most machine-powered, larger, and more expensive drain unclogging devices, while being portable, more effective than manually operated plungers, and at a price affordable to the average person. The invention herein is an easily portable, piston device, powered by any ordinary electric drill with an adjustable bit chuck, often already owned by, or easily accessible to the ordinary person.

BRIEF SUMMARY OF THE INVENTION

A portable, hand-held, piston-operated, pump and vacuum device powered by the attachment of a common, household, electrically powered drill or screwdriver, which can be quickly and easily attached and unattached by means of a protruding shaft on the device, locked into the adjustable chuck of the electrically powered drill or screwdriver, wherein a drill or screwdriver bit is normally secured.

More specifically, a portable device with the piston located, and moving back and forth within a cylinder with two ends, one closed and one open. The open end of the cylinder is designed to be placed over, and around a clogged drain opening so as to form a seal. The piston inside the cylinder; situated in a parallel attitude, in adequate proximity to the wall of the cylinder as to form a seal, then alternately moves toward and away from the most distal end of the open cylinder. The back and forth movement of the piston is actuated by a connecting rod flexibly coupled at one end to the piston, and at the other end, flexibly coupled to a ring, or bevel gear which rotates parallel to the longitudinal direction of movement of the connecting rod and to the longitudinal travel described by the piston. A second, smaller diameter bevel or pinion gear is located in mesh, or rotatable contact with the first-described ring or bevel gears, both gears being situated to one another at a right angle. From this second bevel or pinion gear, a shaft or rod protrudes away from the piston and cylinder, in an attitude perpendicular with the rotational axis of the first described gear. This protruding shaft or rod, is of a diameter of no less than one eighth inch, and on more than one half inch, in order to facilitate an effective, and convenient connection within the adjustable chuck of an electrically powered drill, or screwdriver In addition, a one-way valve is located in either the cylinder wall, (or in other embodiments in the piston) which when the device is actuated and placed over a drain to form a seal, to allow for any gases or fluids exceeding ambient, atmospheric pressure to escape the cylinder upon the piston's down stroke toward the distal end of the cylinder forming a seal over a drain. This same one-way valve, would then close upon the piston's upstroke, or movement toward the closed end of the cylinder and away from the seal former over the drain, by the formation of a vacuum created by the piston's movement. This vacuum created by the piston's upward movement would then suck upon the water column in the drain and any obstruction therein to dislodge or break up the obstruction. As the piston descends, a pressure wave would again push against the water column and obstruction, while also expelling some of the fluid in the column through the one-way or check valve, and upon the piston's ascension re-create a vacuum, thus creating a resonating cycle further disturbing, moving, and ultimately dislodging any obstruction within an obstructed, un-vented section of drain.

10—the combination of electric drill.
20—the electric drill.
30—drain clearing tool.
22—the chuck of the drill.
40—the rotational (part of the fourth member).
34—the cap.
32—the housing, forming the interior cylinder wall (fifth member).
38—the check valve (the sixth member).
36—the flexible flange (flexible flange) surrounding the open end of the cylinder.
42—denotes the flexible flange mating surface.

Figure 2:
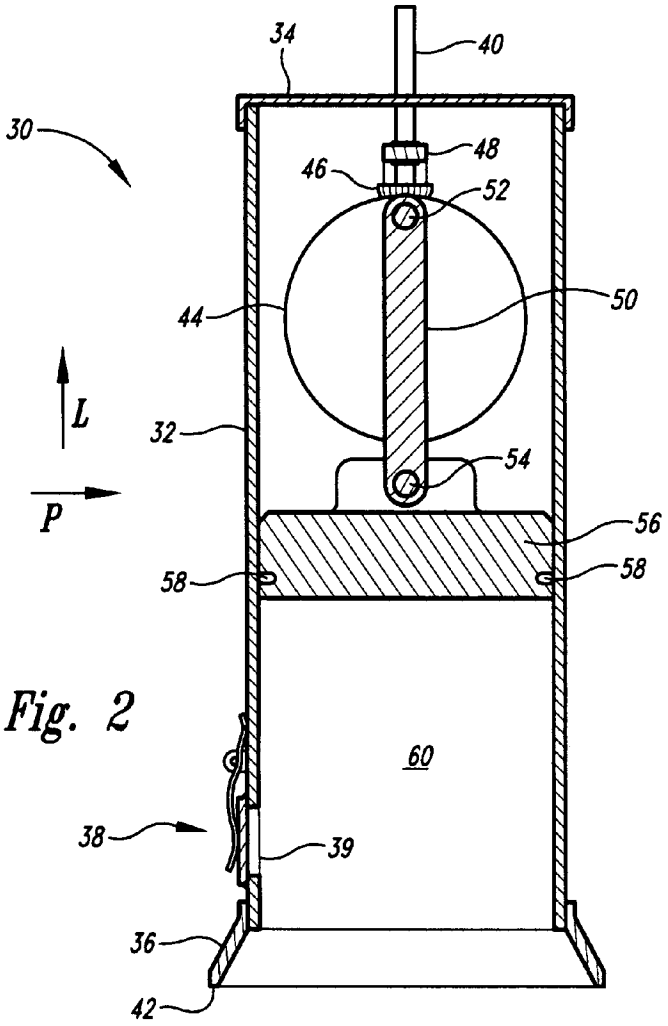

FIG. 2 of the drawings is a transparent frontal view of an implementation, with the piston of the implementation, item 56, located at a top dead-center position within the cylinder chamber, item 60, and with item 38, the check valve in a closed position. The specific items referenced by number on FIG. 2 are as follows:

30—an implementation.
32—the cylinder housing, forming the interior cylinder wall (fifth member).
34—the piston.
40—the rotational shank, (part of the further member).
48—the bracket through which the rotational shank passes.
46—the top of the pinion, or bevel drive gear (part of the fourth member).
52—the crank throw
44—the ring gear or driven bevel gear, (the first member).
50—the connecting rod (the second member).
54—the wrist pin coupling the connecting rod to the piston.
56—the piston.
58—denotes the grove for the location of a sealing ring on the piston.
60—denotes the cylinder chamber, with the piston at top dead center position.
38—a side view of the check valve in closed, or first position.
39—the valve port covered by the check valve.
36—the flexible flange at the open end of the cylinder chamber.
42—the flexible flange mating surface.

Figure 3:
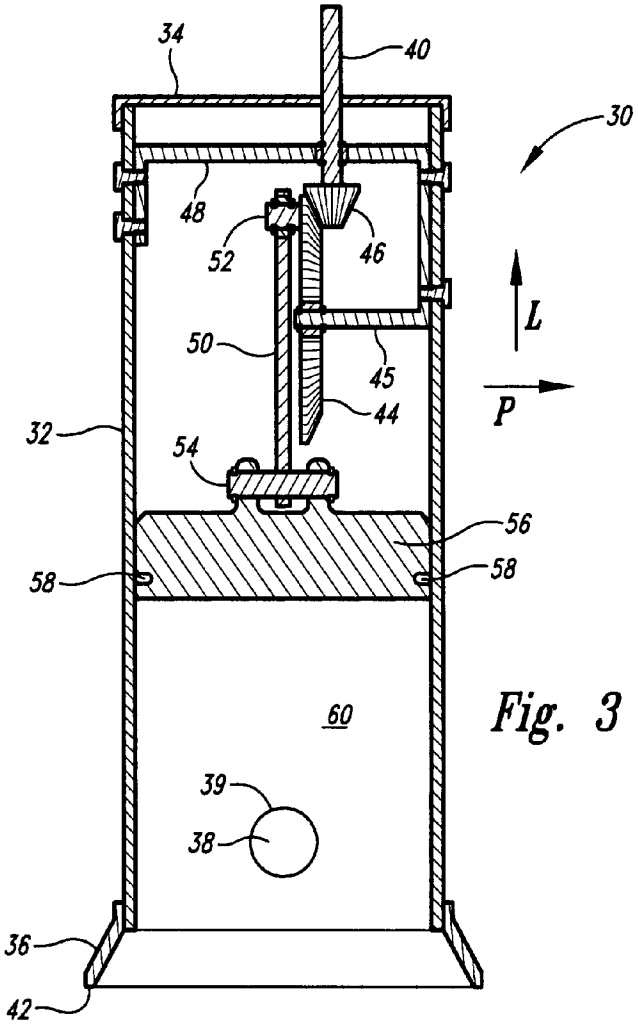

FIG. 3 of the drawings is a transparent rear view of one or more implementations of the invention, with the piston of one or more implementations, item 56, located at a top dead center position within the cylinder chamber, item 60. The specific items referenced by number on FIG. 3 are as follows:

34—the cap
40—the rotational shank (part of the fourth member).
48—the bracket which surrounds and rotationally couples the rotational shank.
30—an implementation.
46—the pinion gear or drive bevel gear (part of the fourth member)
52—the crank throw.
50—the connecting rod (the second member).
45—the ring gear shaft (the third member).
44—the ring gear or driven bevel gear (the first member).
32—the cylinder housing, which forms the cylinder chamber (the fifth member).
54—the wrist pin, which couples the connecting rod (the second member) to the piston.
56—the piston.
58—the sealing ring.
60—the cylinder chamber.
38—the location of the check valve (the sixth member) in closed position behind the valve port.
39—the location of valve port.

Figure 4:
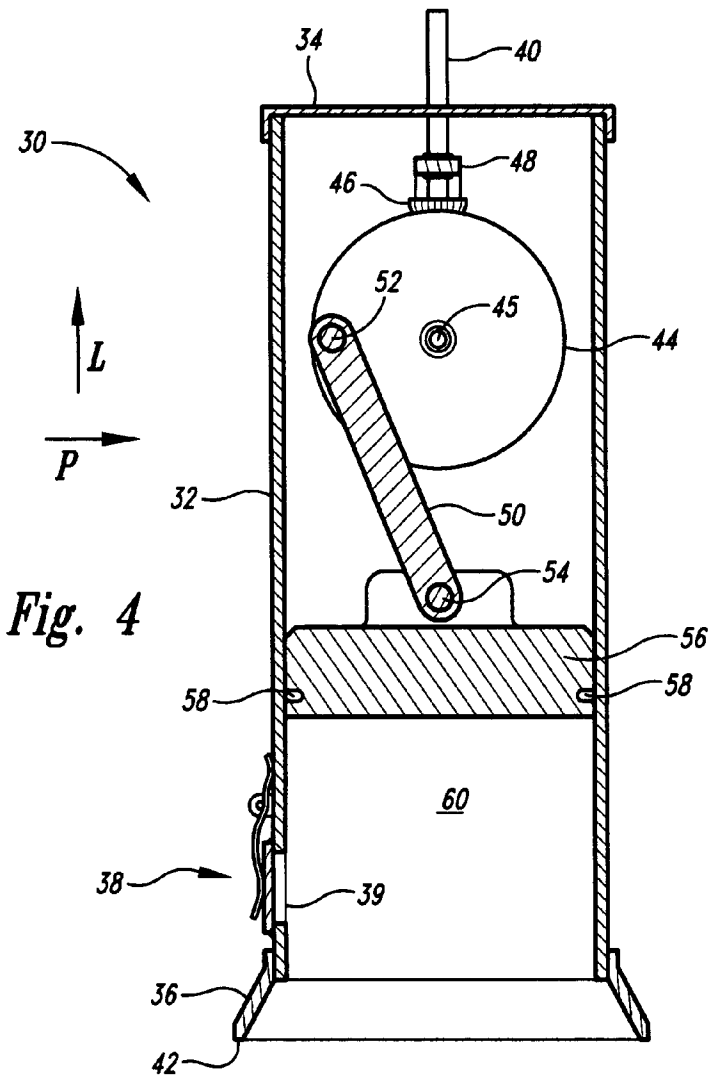

FIG. 4 of the drawings is a transparent side view of an implementation, similar to that of FIG. 2, except that in this drawing the piston, item 56, is in the position at the midpoint within its linear length of its contact with the interior cylinder wall, item 32, located within the cylinder chamber, item 60. Therefore the ring gear, item 44, is shown to have rotated, and in so doing, the crank throw, item 52, has moved to a position parallel to that of the center of the ring gear, item 45. Hiis rotation of the ring gear, has also caused the connecting rod, item 50 to have moved into a semi-oblique position with respect to the direction of travel of the piston, item 56. As this view depicts an implementation in a static position, the check valve, item 38, remains in the closed position upon and over the valve port, item 39.

Figure 5:
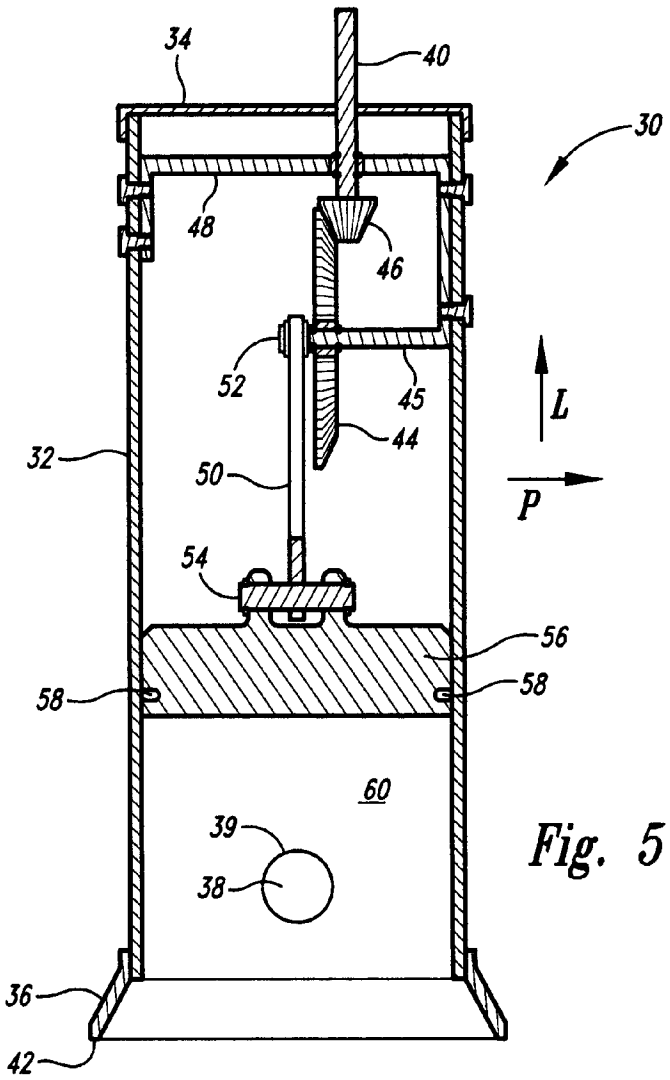

FIG. 5 of the drawings, is a transparent rear view of an implementation similar to FIG. 3, excepting that the piston, item. 56, is depicted at the midpoint of the cylinder chamber, item 60. The crank throw, item 52, is also now in a position parallel with the center of the ring gear (driven bevel gear), while the connecting rod, item 50 appears shorter in FIG. 5, than from its representation in FIG. 3, because its total longitudinal height relative to the cylinder housing, item 32, is shorter owing to it being in a partially oblique position. As in FIG. 4, the drawing of FIG. 5, depicts an implementation in a static position, and thus the valve port, item 39, remains covered by the check valve item 38, in the closed position.

Figure 6:
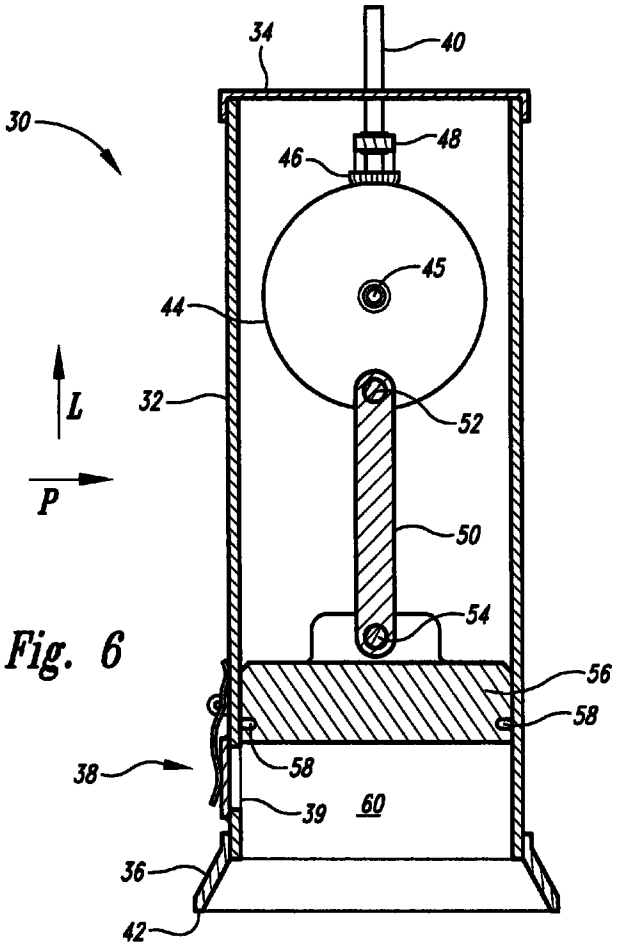

FIG. 6 of the drawings, is transparent side view of an implementation, similar to FIGS. 2 and 4, however in this particular view, the piston, item 56, has traveled to its most distal position from the ring, or driven bevel gear, item 44, within the cylinder chamber, item 60. In this position, the crank throw, item 52 is now located at the bottom center position of the ring gear, item 44. With the piston, item 56, in its position closest to the opening of the cylinder housing, item 32, the connecting rod, item 52, is in a position parallel to the housing of the cylinder. As in FIGS. 2-5, this drawing also depicts an implementation in a static position, so the check valve, item 38, remains in a closed position over the valve port, item 39.

FIG. 7, of the drawings is again a transparent rear view of an implementation, and as in the previous FIG. 4, the piston, item 56, is in its maximum distal position from the ring gear, item 44. In this view, the connecting rod, item 50 is also extended to its full length relative to the housing, item 32. Labeled as FIG. 8, in bold type, is an encircled portion of an implementation to be more specifically displayed, and the items therein denoted in FIG. 8, the drawing to follow.

Figure 7:
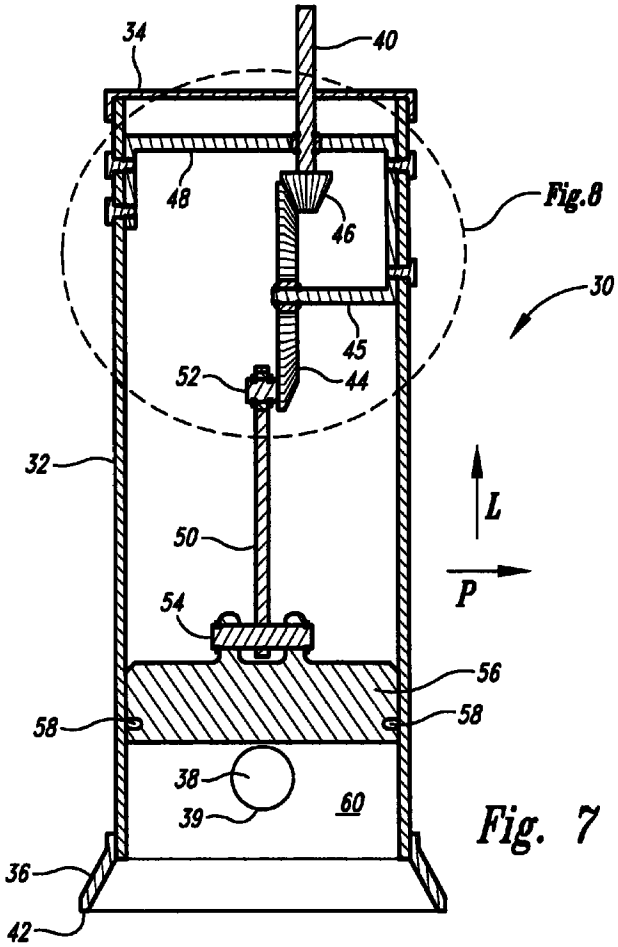
Figure 8:
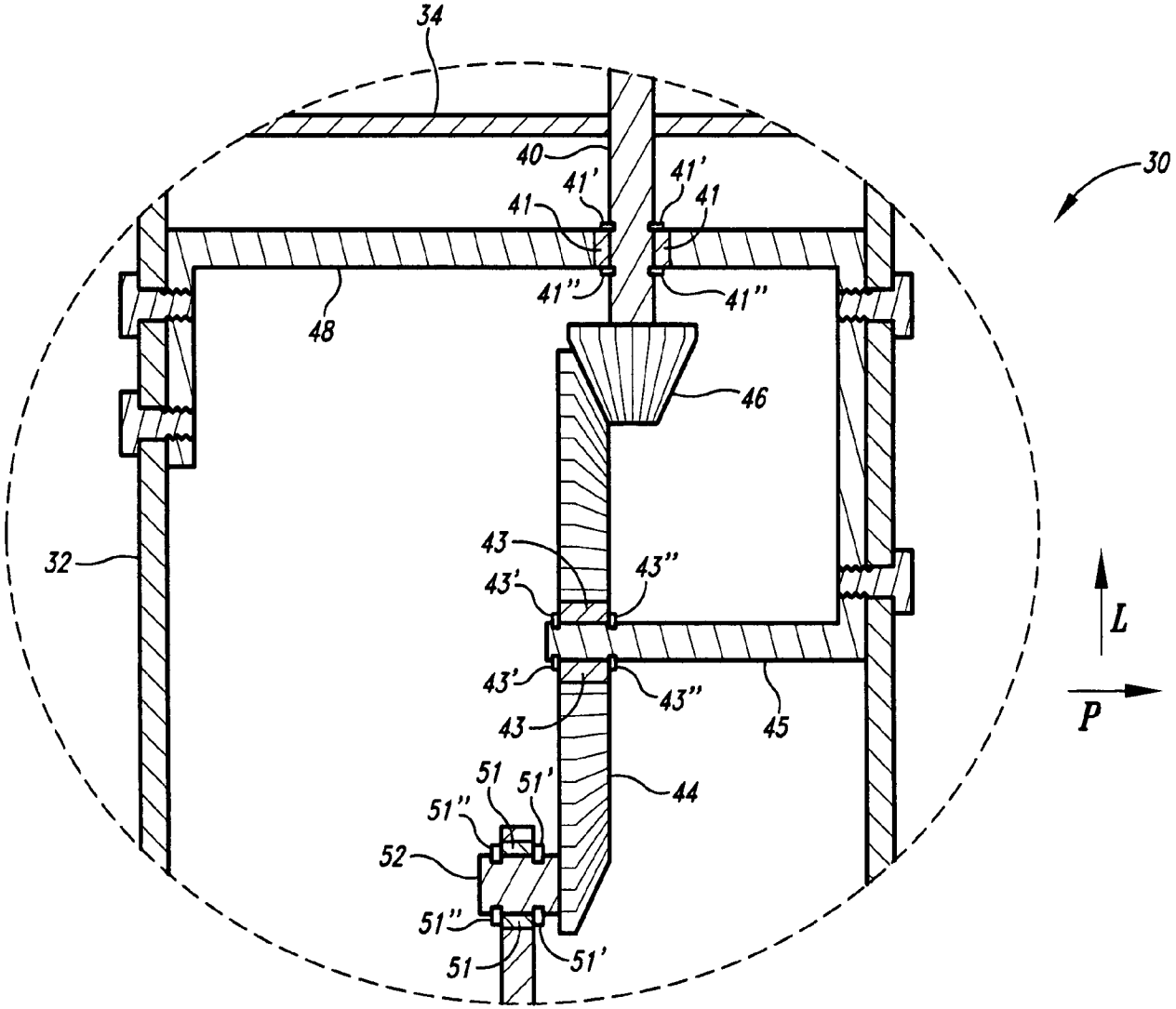

FIG. 8 Is a magnified view of the encircled portion noted in the previous drawing, FIG. 7. This more detailed view of an implementation, contains the following parts of the as follows:

32—the housing forming the interior cylinder wall (fifth member).
34—the cap.
40—the rotating shank (part of the fourth member).
41—the shank bushing
41'—the first retaining ring which holds the rotating shank (part of the fourth member) in place.
41"—the second retaining ring which also holds the rotating shank (fourth member) in place.
48—the bracket coupling both the shank bushing, and the rotating shank (fourth member) in place.
46—the pinion gear or drive bevel gear (the fourth member) attached to the rotating shank.
43—the ring gear bushing.
43'—the first retaining ring.
43"—the second retaining ring.
44—the bevel gear or driven bevel gear (the first member).
51—the connecting rod bushing.
51'—the first retaining ring.
51"—the second retaining ring.
52—the crank throw.

Figure 9:
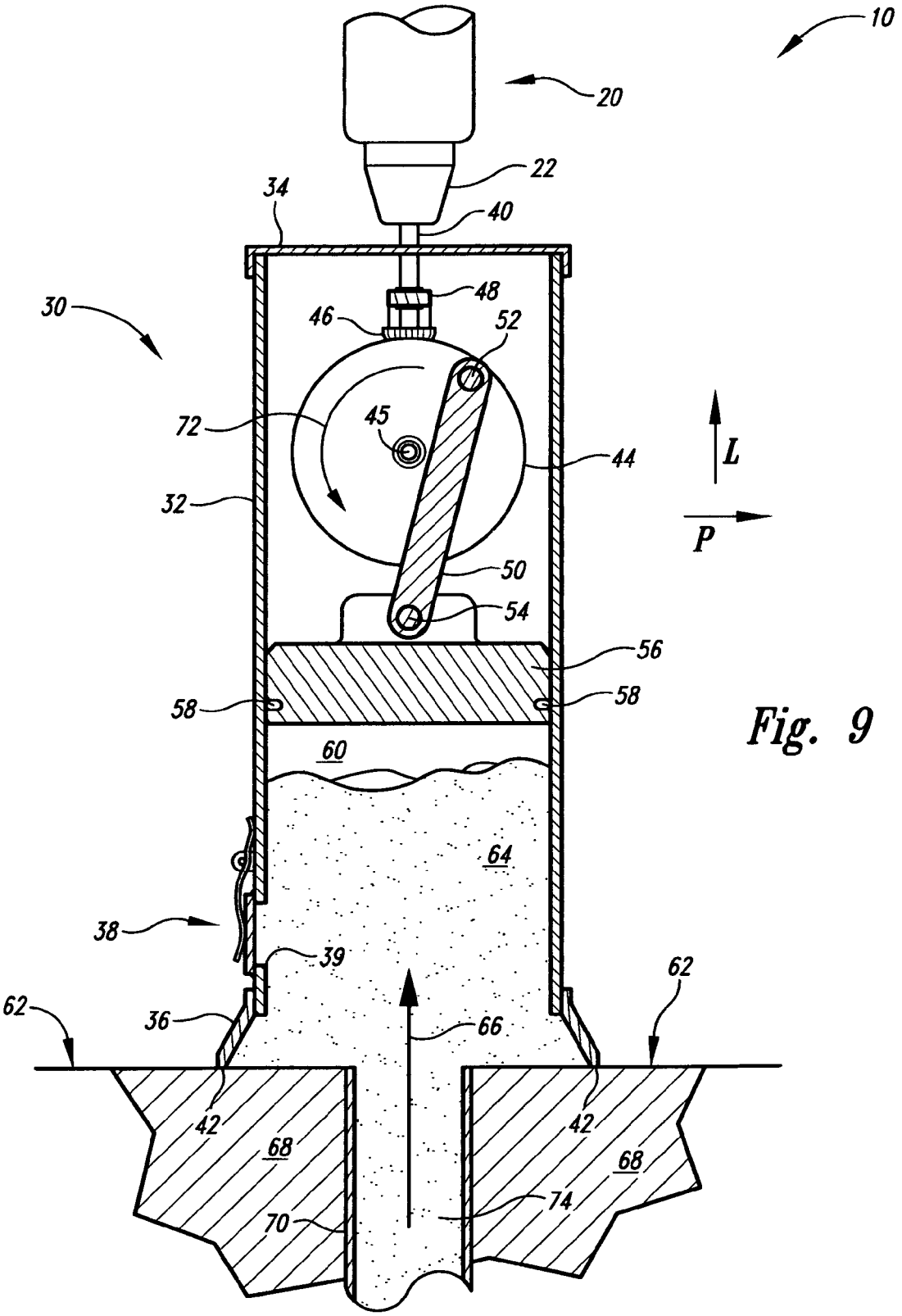

FIG. 9 is a transparent view of an implementation and as a complete assembly, item 10, depicting an implementation connected to an electric drill, item 20, by the contact of the chuck, item 22, to the rotary shank of an implementation, item 40, through which the drill acting as a rotary power source is motivating the pinion bevel gear, item 46, to drive the ring gear, item 44, and thus through its coupling with the crank throw, item 52, to the connecting rod, item 50, to cause the connecting rod to transfer rectilinear motion to move the piston, item 56, through their common connection by the wrist pin, item 54, thereby, to result in the piston moving in a longitudinal motion along the interior length of the cylinder chamber, item 60, and in so doing creating a vacuum resulting in a suction upon the fluid in drain, item 74, and thus a fluid flow from the drain, item 66, which acts to dislodge any obstruction within the drain conduit, item 70. In this mode of operation, the check valve, item 38 is drawn closed over the valve port, item 39, thus creating suction forces within the cylinder chamber, item 64, as the piston, item 56, rises.

Figure 10:
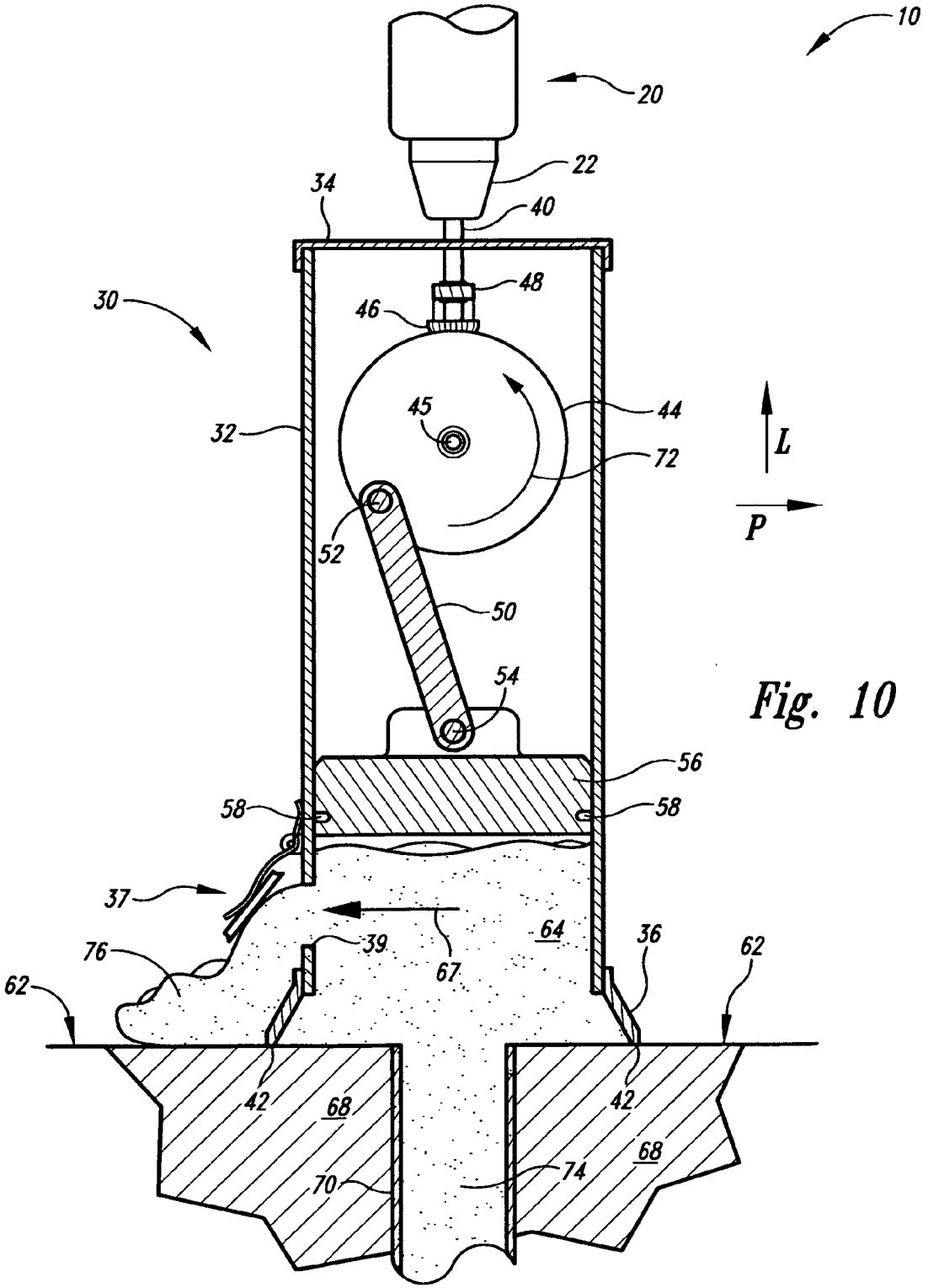

FIG. 10 is a transparent view of an implementation, again together showing a portion of an attached electric drill as a motivating force, combining to make a complete assembly, item 10. As in FIG. 9, the rotary force of the drill, item 20, is transferred through the rotational shank, item 40, to rotate the pinion gear, item 46, which in turn rotates the ring gear, item 44 in a longitudinal plane, and thereby rotates the attached crank throw, item 52, which is in this view rotated to a position past top dead center, and is in a descending position, thereby pushing down the connecting rod, item 50, in a rectilinear motion, which in turn pushes down the piston, item 56. This downward movement of the piston, item 56, causes compression upon the fluid in the drain, item 74, which now also fills the cylinder chamber, item 60, and results in two simultaneous actions. One of these actions is that the fluid in the drain, item 74, transfers some of this compressive force, as a resonant force, to act upon, and loosen any obstructing material within the drain, item 70. A second simultaneous action of the compression of the fluid in the drain, item 74, and the cylinder chamber, item 60, is that the pressure upon the fluid, pushes the check valve in the open position, item 37, allowing a fluid flow from the cylinder, item 67, out through the valve port, item 39, thereby reducing the total amount of fluid within the combined volume of the cylinder chamber, item 60, and the drain, and plumbing conduit, item 70.

DETAILED DESCRIPTION

For the purpose of understanding, reference will be made to the drawings illustrated in FIGS. 2, 3, 8, 9, and 10, and specific items thereon.

It should also be understood that no limitation on the scope is hereby intended by either the reference to these drawings, or the description herein, in regard to the principles, as other alternative embodiments not shown in the drawings are possible and shall be indicated at the salient points in this description. None of the drawings are to an exact scale, as the views of the drawings are principally drawn as semi-transparent perspectives in order to aid in a better understanding of the principles.

To best describe and understand construction of an implementation, this description will begin with references to numbered items in FIGS. 2 and 3 of the drawings. Item 32 of that drawing depicts the largest single component of an implementation, the housing which makes up the interior cylinder walls, and the cylinder chamber, as well as providing a structure upon which to couple the rest of an implementation. This housing may be made or sourced from any tube or pipe available, and from any rigid material, that provides a continuous, and smooth interior surface, and is of a uniform and consistent, round diameter, in other embodiments oval or elliptically shaped housing could be constructed. However, for the purpose of this embodiment, the shape of the cylinder will be circular and will be intended to be operated with a piston, item 56 of FIG. 2, of circular shape. No exact interior diameter of the housing is necessarily required, other than to ensure that the minimum size cylinder material used, is large enough to enclose the diameter of the smallest drain upon which an implementation is intended to be used, while also being large enough to facilitate the making of a seal on any larger drains to be cleared, such as toilet drains. For the purpose of the description of an implementation, the pipe or tube used to construct the cylinder will be of plastic pipe with an interior diameter of 4 inches. Also for purposes of description, the plastic pipe will be used to construct both the cylinder chamber, FIG. 2, item 60, as well as a framework to provide a rigid structure to support and flexibly couple the rotational shank, item 40, the cap, item 34, the bracket, item 48 which helps support the rotational shaft, as well as providing a coupling point for the ring gear shaft, item 45, about which the ring gear, item 44 rotates. This pipe or tubing will also serve to enclose the moving parts for the safety of the user. Therefore the length of the plastic pipe used to construct an implementation shall be at least 16 inches but no more than 18 inches, although in other embodiments designed for a longer stroke, or embodiments which do not utilize the cylinder housing, item 32, itself as part of the framework to directly couple the rotating shafts, coupled to either of the bevel gears of an implementation, the cylinder housing, item 32, and also the cylinder chamber, item 60, may respectively be either longer or shorter in length.

Item 56 of an implementation as shown on FIGS. 2 and 3, is the piston. The piston may again be made of any rigid material but for the purpose of this specific embodiment, the material used will be a portion of hardwood, circularly cut in a diameter of slightly less than 4 inches, from a board, or other portion of hardwood with two flat, parallel surfaces, of at least 1½ inches in thickness, but no more than 2½ inches thick. For the purpose of the selected embodiment, the piston shall be made of no less than 3.96 inches in diameter, and no more than 3.98 inches in diameter. This will be done by first drawing a circle of 4 inches upon the board or portion of hardwood to be employed as piston material, and then by using that marking as a guide, neatly cutting out the marked portion, to obtain a disk of wood 4 inches in diameter. Then by employing varying grits of progressively finer sand paper, files, or grinding wheels, the curved surface of the disk should be reduced down, as uniformly as possible, until a very smooth surface is obtained, to a uniform diameter of the resulting hardwood disk, to between 3.96 and 3.98 inches. Thus resulting in a piston of at least 1½ inches, but nor more than 2½ inches in height for the purpose of the described embodiment. However the height of the piston may vary in other embodiments, with the minimum height dependent upon the minimum required to insure that the piston remains in a parallel and uniform attitude to the interior wall of the cylinder housing, item 32, so as not to tumble, tip, or become lodged or bound within the cylinder chamber, item 60. Although not employed, additional rings, or seals may be coupled to the piston, by the addition of a grove or channel within the circumference of the exterior wall of the piston, as seen in item 58, of FIGS. 2 and 3. Such rings or seals encircle the piston and are of a cross-sectional shape and diameter to fit within the grove within the exterior circumference of the exterior piston wall, and are of plastic, rubber, or metallic construction of sufficient elasticity to provide a more perfect seal between the piston and cylinder walls, without binding or breaking. On the top of the disk intended to be the piston, at its exact center, a hole perpendicular to the surface of the disk, shall be drilled of a diameter, to provide a pilot hole, into which a threaded wood screw will later be inserted to secure a bracket that will couple the wrist pin, item 54 of FIGS. 2 and 3. To flexibly couple the connecting rod, item 50, to the piston, item 56 of FIGS. 2 and 3. In an implementation, this bracket designed to hold the wrist pin, and to be secured to the center of the wood disk will be of a steel flat-bar, 1/16$^{th}$ inch in thickness, ¾ inch in width, and 3 inches long. Into this flat bar near each end, two holes of a diameter to allow the fit of a ¼ inch diameter wrist pin, will be drilled. With the flat bar being oriented lying horizontally on either its ¾ inch sides, one hole is drilled in the center of the flat bar, at a point ⅜$^{th}$ inch from each edge of the bar, this hole shall be of a diameter to allow the insertion of ¼ inch self-threading wood screw. The remaining two holes of a diameter to accommodate a wrist pin of ¼ inch diameter, shall be drilled at each respective end at a point ⅜$^{th}$ inch from each end of the flat bar, and ⅜$^{th}$ inch from each edge. The flat bar will then be bent at a right angle, at a point 1 inch from each end, to form a simple, channel-shaped bracket with two parallel sides with holes. Through the center hole of the bracket, the bracket is coupled to the top of the piston at its center point, by inserted and securing a self-threading screw of ¼ inch diameter, and 1 inch in length into the previously drilled pilot hole in the hardwood disk. A wrist pin of ¼ inch in diameter and approximately 2 inches in length shall for sake of simplicity and ease of construction, be made by utilizing a threaded bolt and appropriately fitting lock nut, of ¼ inch diameter.

To this bracket, a connecting rod, item 50 of FIGS. 2 and 3, shall be made to flexibly coupled by means of the wrist pin, to the wood disk, or piston. To make the connecting rod, a portion of flat bar steel ⅜$^{th}$ inch thick, by ½ inch wide, by 5 inches in length, shall be cut and laid horizontally upon its side, ¾ inch in width. Two holes of to accommodate round members of ¼ inch in diameter shall be drilled ⅜$^{th}$ inch from each respective end of the bar, at a point ⅜ inch from each edge of the bar. Each of the four corners of the member shall then be filed, ground, or cut to leave each rounded in shape so as to prevent any external binding of the member with the bracket attachment, or other portions of the device. The connecting rod is then flexibly coupled to the piston by inserting the wrist pin described above, into one of the two parallel holes in the bracket secured to the top of disk, while ensuring the newly made, flexible coupling between the connecting member and wrist pin, allows easy movement of the connecting rod about the axis of the wrist pin. If desired, round spacers with a center hole of a diameter to allow easy rotation about the wrist pin, may be placed between the wrist pin and the inside of bracket, to keep the connecting rod from moving back and forth along the length of the wrist pin excessively.

For an implementation, two commercially available steel, pinion or bevel gears shall be obtained. These gears shall have individual gear teeth designed to mesh with one another at a 90 degree angle to form what is commonly known as a bevel gear. One of the gears should be of markedly smaller diameter, and corresponding number of individual gear teeth, to establish a ratio when meshed and rotating concurrently with the larger gear, of at least four, and no more than six revolutions of the smaller gear, to every one revolution of the larger gear. For the purpose of an implementation, the larger, or ring gear shall be no less than 3 inches in diameter, and no more than 3½ inches in diameter, with a hole at the center to accommodate a fixed axis of preferably ¼ inch in diameter, about which this larger bevel gear shall rotate and function as the ring gear, item 44 of FIGS. 2 and 3. The smaller gear of the above described ratio, designed to mesh at a right angle with the larger gear, and shown as item 46 of FIGS. 2 and 3, shall have a hole in its center to accommodate a shaft ⅜$^{th}$ inch diameter, if a gear with the appropriate ratio cannot be found with a center hole of that diameter center hole, a gear with a smaller hole may be increased to by drilling with a drill of a diameter to accommodate a 3/s inch diameter shaft. Into the center hole of this smaller gear, a round steel rod or shaft of Vs$^{1'}$ inch diameter, and of approximately 4 inches in length shall be inserted into the center hole of the smaller gear in such a way that one end of the rod or shaft is inserted to a point where the rod or shaft transverses the full depth of the hub of the gear, to a point flush with the side of the gear hub, opposite from which the rod was inserted. For the purpose of this embodiment, the shaft inserted into the smaller gear shall be rigidly secured by use of a spot weld. Thus leaving the remainder of the rod or shaft inserted into the center of the smaller gear, to protrude out of the hub of the gear at a right angle, and when installed in the device, up through the bracket, item 48, and cap, item 34, as depicted in FIGS. 2 and 3.

For the purpose of flexibly coupling the connecting rod to the larger, or ring gear, item 44, a threaded rod or bolt of a diameter to loosely fit a ¼ inch diameter hole, will be attached on the side of the gear opposite to the side with the gear teeth. This will be to act as the crank throw, item 52, FIGS. 2 and 3. The rod or bolt should be located as close to outer, rim of the larger gear as practical, so long as it does not hinder, impede, or bind the meshing of the teeth of the larger gear, with the smaller gear when both are in final placement. The method of attachment shall be made by use of an electric arc weld, and great care should be taken when placing the threaded rod or bolt, to insure that it is as parallel as possible to the center rotational axis of the gear. The rod or bolt will be of steel, and of at least % inch, but no more than 1⅛$^{th}$ inches in length, with the last half inch being threaded, for the purpose of the attachment of a threaded, stop nut to fit.

Returning to the housing of the cylinder, item 32 of FIGS. 2 and 3, a simple framework of steel sheet metal at 1/16$^{th}$ inch thickness, shall be fashioned to construct the cap, item 34. The cap itself can be constructed out on any light gauge sheet metal, by first placing the pipe or tubing to be used to create the housing, item 32, upon a portion of sheet metal, then tracing around the tubing, marking a circle upon the metal. As the rotational shank, item 40, will pass through the cap, a hole must be drilled in the cap to accommodate it. It would be advisable, to leave the drilling of this hole to a point in time, when the exact location of the rotational shaft, item 40 has been determined. At that time, the hole may be made at the appropriate position within the area of the cap, by simply drilling a hole measured to accommodate, the rotational shaft's diameter of 3/s inch. Returning to the actual sizing of the sheet metal to be used as the cap, cut a second concentric circle out of the material around the original circle, that is approximately of 1 inch greater radius. With this larger circle, cutting in toward the center from the outside edge, oblique cuts are made from the edge to the outside edge of the inner circle, to form a series of triangles which surround the inner circle. The will later be bent over at a right angle from the surface of the inner circle to form tabs which can either be glued to the pipe or tubing material which forms the housing, item 32, of an implementation, or holes can be drilled through some or all of the tabs, through which short self-tapping screws can be inserted into drilled, pilot holes, drilled partially into the wall of the cylinder housing, item 32. Any screws used to fasten the cap, should not be of a length greater than that of the combined thickness of the cut sheet metal, and the cylinder housing wall.

A framework to secure the axis of the two gears in mesh, which is identified as the bracket, item 48, to the interior wall of the cylinder housing, item 32, of an implementation, will be made in an implementation of mild steel bar stock. To accomplish this, the bar stock selected for the construction of the cylinder, shall be of ¾ inch width, ¼ inch thickness, and between eight and nine inches in length. The bar stock will then, first be bent to form a longitudinal portion of a length equal to that of the distance the combined radius of the ring gear, item 44, and the length needed to attach a round member, longitudinal member to act as an axis for the ring gear at the center of the ring gear, item 45, and adding the preferred height desired above, and to accommodate, the free and easy rotation of the pinion gear, item 46, and any its second retaining ring, item 41", FIG. 8. when the two gears are in mesh at a right angle. A second bend will be made at right angle at a point, and in a direction which will result in a three sided member, with to parallel sides, which allows the second bent length of the member to exactly traverse the diameter of the cylinder chamber, item 60, while also allowing for the accommodation of the thickness of both, now parallel ends of the member, so as to fit within the cylinder chamber, to form the bracket, item 48. Holes will then be drilled through each vertical leg of the member, to be matched later by holes drilled through the cylinder housing, item 32, so as to allow the insertion of threaded screws or bolts, to be secured by threaded nuts. However, before the newly made bracket is installed, a round rod of sufficient length to extend from the interior surface of the longest leg of the bracket intended to be fixedly coupled to the interior of the cylinder housing wall, item 32, and parallel with the center of the ring gear, item 44, while in operating position, to past the eventual distal surface of the hub of the center of the ring gear, item 44, from the interior of the bracket, item 48, to form the ring gear shaft, item 45. This rod to later make up the ring gear shaft, item 45, shall be made of steel and of a diameter of 3/s inch diameter, and shall have groves cut by lathe to accommodate the first retaining ring, item 43' FIG. 8, and the second retaining ring, item 43", FIG. 8. The steel rod shall then be attached to the bracket, item 48, FIGS. 2 and 3, near the end point of the longest vertical leg of the bracket, by arc weld, at a right angle to form the axis for the ring gear, at the center of the ring gear, item 45, FIGS. 2 and 3. It is noteworthy, that in other embodiments, the ring gear shaft, item 45, could be fixedly coupled to the ring gear, item 44, and rotationally coupled through the bracket item 48, and or the cylinder housing, item 32, so as to allow direct transfer of external, rotary motive force through to ring gear, from an external source in the perpendicular plane.

Once the bar stock has been so configured into the bracket, item 48, a hole to accommodate the ⅜$^{th}$ diameter rotational shaft, and the additional diameter of its shank bushing, item 41, FIG. 8, is drilled through the bar stock, at the point located between the vertical center point of the cylinder chamber, item 60, FIGS. 2 and 3, and the external interior of the outer diameter of the cylinder chamber, item 32, where the rotational shank, item 40 will extend longitudinally from the pinion gear, item 46, when installed in an operating configuration with the ring gear, item 44. This perpendicularly determined distance of the offset of the hole from the center of the cylinder chamber, item 60, being determined by the radius of the pinion gear, item 46, to be used, added to the distance from the proximate edge of that pinion gear, to the longitudinal, center line of the intended longitudinal path of the connecting rod, item 50, when it is attached to the piston, item 56, and both are located in an intended operable attitude within the cylinder chamber, item 60, and connected to the piston, item 56, on one end, and at the other end, the crank throw, item 52. When that exact position has been determined, and the metal bar stock drilled, the top cap, item 32, may then be temporarily installed, and marked in a position parallel with that of the hole drilled in the bracket, item 48, and a hole drilled in a diameter to accommodate the diameter of the rotational shank, item 40.

At the point where the rotational shank, item 40, passes through the bracket, item 48, when the pinion gear, item 46, is installed and property meshed with the, also installed ring gear, item 44, marks shall be made upon the rotational shank, item 40, immediately above and below where the shank passes through the bracket, item 48, and grooves to accommodate the first shank retaining ring, item 41', and the second shank retaining ring, item 41", FIG. 8 shall be cut. The ring grooves cut, must be positioned so as to allow the free and easy rotation of the shaft without either retaining ring used, binding with the shank bushing, item 41, FIG. 8, or the bracket, item 48.

Moving on to the construction of the flexible flange, item 36, FIG. 9, this portion of an implementation can be made from any of a number of commercially available, flexible plastic, or rubber molding products, of a sufficient malleability, to easily conform to surface of a plumbing fixture surrounding a drain, so as to form a water-tight seal around the drain opening. As molding products of this type, are commonly sold in roll form, once an appropriate type of molding has been selected having both the malleable characteristic, and having at least one flat surface suitable be glued to the lowest external circumference of the cylinder housing, item 32, a linear piece of the molding is cut to a length to fully encircle the exterior circumference of the cylinder housing without either a gap, or overlap of excess material, where the ends of the molding piece meet, when fitting around the cylinder housing near its open end. Once the molding material is in the satisfactory length described, an upper portion of an inside flat edge of the material may be glued to the cylinder housing, item 32, FIG. 9, and with a lower portion of the material, being allowed to project downward from the open end of the housing, to form the flexible flange, as shown as item 36, FIG. 9.

For the purpose of an implementation, the valve port, item 39, FIG. 9, shall be constructed by the drilling of a hole ¾ inch in diameter, through one side of the cylinder housing, item 32, at a point centered approximately 1½ inches from the bottom of the housing, or as low as is practical, without the hole intended to be the valve port, item 39, or the check valve, item 38, coming into contact with the flexible flange, item 36, the desired relationship of which, is illustrated in FIG. 9. To construct the check valve, a circular flexible plastic, or rubber cover is cut from the most suitable material available, in a diameter of not less than 7/s inch, but not more than 1¼ inches. The material selected should be malleable enough on the side intended to come into contact with the exterior of the cylinder housing surface, item 32, to form an air tight seal when the piston, item 56 of an implementation is traveling upward in the cylinder chamber, item 60, and the material should also be rigid enough to maintain its shape, and to which a light steel spring, or flexible retainer can be attached, as in the matter as seen as the check valve, item 38, FIG. 9. A steel hairpin, or flat spring designed to allow the opening and closing of small orifice covers in response to internal out-pressure, shall be affixed at one end to the plastic or rubber cover, intended to act as the check valve, by means of either adhesive, rivet, or small threaded screw and nut. The other end of this spring, shall then be affixed to the exterior of the cylinder housing, item 32, in a manner such that the tension of the spring, acts to hold the plastic or rubber cover firmly against the cylinder housing, as seen as item 38, of FIG. 9. The portion the spring opposite the portion affixed to the rubber or plastic cover, shall be affixed to the exterior of the cylinder housing, item 32, by means of a small bracket covering that portion, and held in place by two threaded screws, screwed directly into the cylinder housing, but of a maximum length, that does not exceed the thickness of the cylinder housing, and thus prevent perforation of the interior surface of the cylinder housing.

The bracket, item 48 of FIGS. 2 and 3, may now be attached to the interior of the cylinder housing by threaded bolts or nuts and screws, by drilling the appropriately corresponding holes through the cylinder housing, item 32, at points which will allow the piston, item 56, when attached to the ring gear, item 44, via the connecting rod, item 50, to make a full longitudinal stroke without the piston protruding below the open end of the cylinder chamber, item 60, and while simultaneously allowing the ring gear, item 44, and the pinion gear, item 46, to correctly mesh, and while also allowing the rotational shank, item 40, to align longitudinally, in a position to allow the insertion of the bushing, item 41, and the first and second retaining rings, items 41' and 41" respectively of FIG. 8; and finally while also allowing the rotational shank, item 40, to protrude sufficiently through the cap, item 32, in order than it can be easily attached by the chuck, item 22, of the drill or rotational tool, item 20. Once the correct position has been determined, and the bracket, item 48 affixed to the housing, the shank bushing, item 41, the rotational shank, item 40, and the pinion gear, item, 46 may be installed by inserting the end of the rotational shank up through the bracket, item 48, and affixing the first and second retaining rings, items 41' and 41" respectively above and below the bracket, item 48, into the grooves cut into the rotational shank, item 40.

Once the pinion gear item 46, together with the rotational shaft, item 40, are installed through the bracket, item 48, and the ring gear bushing, item 43, FIG. 8, the ring gear, item 44, shall be installed upon the ringer gear shaft, item 45, extending perpendicularly from near the lowest part of the bracket, item 48, toward the center of the cylinder chamber, item 60, the ring gear, item 44, is then rotationally coupled to the ring gear shaft, item 45, so that the geared teeth of the larger ring gear, and the smaller pinion gear, both mesh at a right angle to one another. At this point the first and second retaining rings, items 43' and 43" respectively, FIG. 8, shall be inserted into the grooves previously cut into the circumference of the ring gear shaft, item 45, located near the open end of the ring gear, item 45, FIG. 8.

For the purpose of an implementation, the connecting rod, item 50, having been previously attached to the piston, item 56, through its distal end, via its perforation by the wrist pin, item 54. will be coupled to the crank throw, item 53 simply by placing the hole at the end of the connecting rod, opposite the end to which is attached to the piston, item 56, via the wrist pin, item 54, over the crank throw, item 53, and installing a self-locking nut to secure the connecting rod in place, but not so tightly as to impede the free longitudinal movement of the connecting rod, through the longitudinal direction of the piston within the cylinder chamber, item 60. Should it be desirable, round washers of a diameter to fit the crank throw, may be installed upon the crank throw, on either side of the connecting rod hole, in order to center the connecting rod, item 50, in as parallel an attitude as is practical, in relation to the interior walls of the cylinder housing, item 32.

Figure 1:
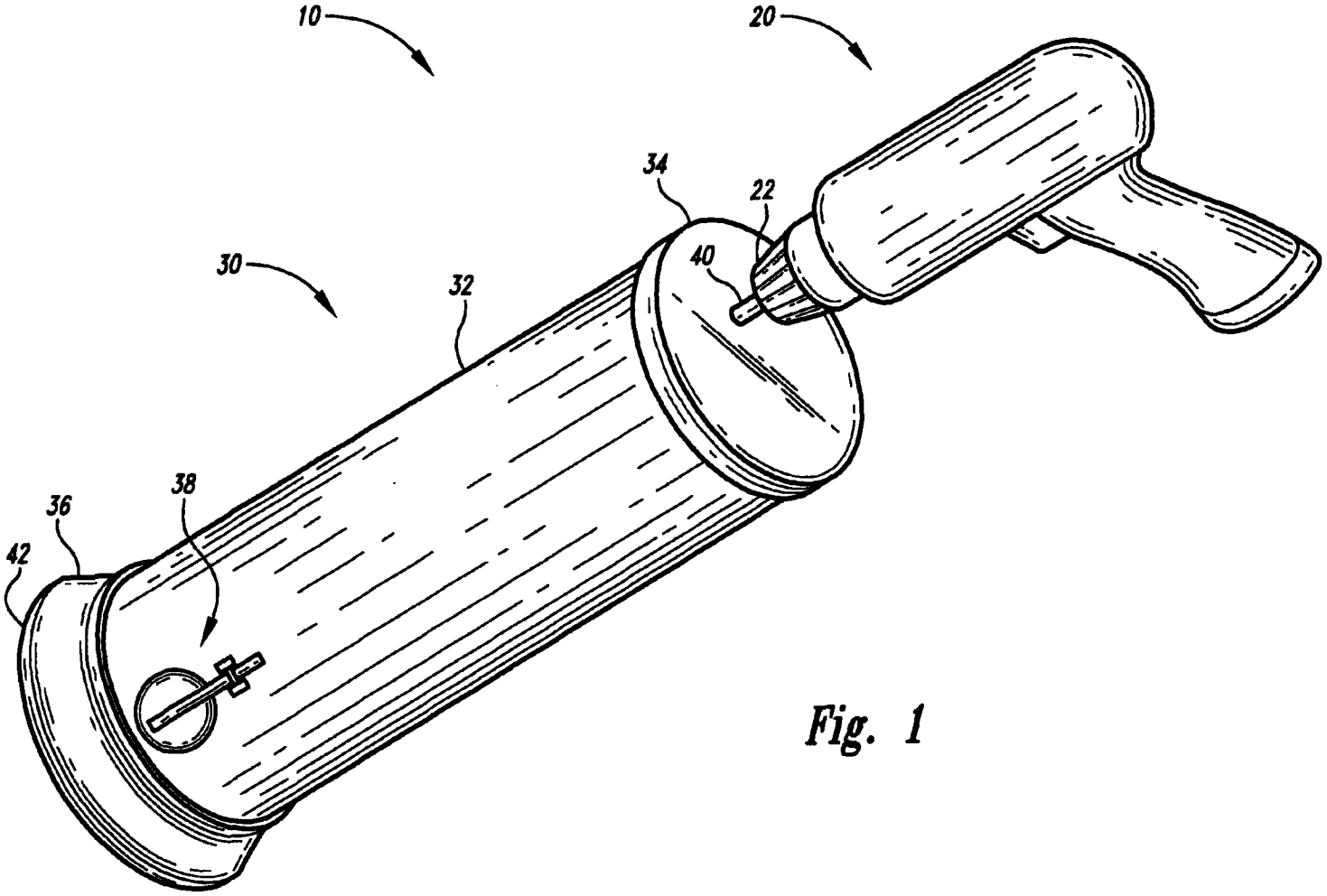
FIG. 1 of the drawings is a view of the device attached to an electric drill. In all drawings, longitudinal and perpendicular directions are identified by the capital letters, L, and P, respectively. The items referred to by number are as follows, with those specifically referred to in the claims by a different term, additionally noted in parentheses.

With the rotational shaft, item 40, in place, the cap, item 34, can now be drilled to allow the passage of the rotational shaft. The diameter of the hole drilled in the cap, must be such that it allows the free rotation, of the rotational shaft, item 40. The hole to be drilled shall be placed such as to be located the same distance as from the inside circle originally drawn on the sheet metal making up the cap, as that distance between the center of the diameter of the rotational shaft, item 40, and the closest point of the exterior edge of the housing, item 32. Once this has been completed, the cap is simply slipped down over the rotational shaft through the newly drilled hole, to a point where the bottom of the horizontal surface of the cap, comes into direct contact with the top of the housing. Once in place, the cap may be secured either by prior application of adhesive between the respective surfaces of the cap and housing that come into contact, or by externally the drilled pilot holes through the previously drilled vertical tabs of the cap, into the wall of the cylinder housing, of a depth to allow insertion of self-tapping, threaded screws, but not so deep as to drill completely through the cylinder housing. With the insertion of the appropriate length screws of the diameter to fit the holes, the cap, item 32 is secured. At this point an implementation should appear as similar in appearance to item 30, FIG. 1

It is claimed:

1. A drain clearing apparatus comprising:

a cylinder housing including longitudinally opposite first and second ends and a cylinder wall extending therebetween, the first end including an opening, the cylinder wall including an interior surface;

a piston slidably coupled with the interior surface of the cylinder wall;

a first member rotationally coupled to the cylinder wall, about a rotational axis oriented substantially perpendicular to the longitudinal direction; and a second member hingedly coupled to the first member and hingedly coupled to the piston; and a fourth member oriented to extend in the longitudinal direction, the fourth member rotationally coupled with the first member to rotate the first member about the rotational axis substantially perpendicular to the longitudinal direction;

wherein the fourth member includes an end configured to be coupled with an electric drill.

2. The drain clearing apparatus of claim 1, further comprising a third member wherein the first member is rotationally coupled to the third member, and the third member is fixedly coupled to the cylinder wall thereby rotationally coupling the first member to the cylinder wall.

3. The drain clearing apparatus of claim 1, further comprising beveled gearing.

4. The drain clearing apparatus of claim 1, wherein the piston has opposite first and second sides, the first side facing the first member and the second side facing the opening of the cylinder, wherein the second side of the piston has a range of travel including a first travel position and a second travel position, the first travel position having a first distance from the opening of the cylinder and the second travel position having a second distance from the opening of the cylinder, the first distance being smaller than the second distance, and wherein the cylinder wall further comprises:

a valve port located within range of travel of the piston such that the one or more orifices are located between the first travel position and the second travel position of the second side of the piston.

5. The drain clearing apparatus of claim 4, further comprising a check valve for the valve port.

6. The drain clearing apparatus of claim 1, further comprising a flexible flange material, wherein the cylinder wall includes an exterior, the flexible flange material fixedly coupled to the exterior of the cylinder wall, extending along the longitudinal direction away from the opening.

7. A drain clearing apparatus comprising:

a tube having an interior wall and an open end;

a piston slidably coupled with the interior wall of the tube, the piston having a piston end accessible through the open end of the tube;

means for translating rotational motion into linear motion to impart linear motion to the piston; and means for coupling an electric drill to provide the rotational motion.

8. The drain clearing apparatus of claim 7, further comprising means for sealably coupling the open end of the tube with a drain opening.

9. A drain clearing apparatus comprising:

a cylinder housing including longitudinally opposite first and second ends and a cylinder wall extending therebetween, the first end including an opening, the cylinder wall including an interior surface;

a piston slidably coupled with the interior surface of the cylinder wall;

a first member rotationally coupled to the cylinder wall, about a rotational axis oriented substantially perpendicular to the longitudinal direction;

a second member hingedly coupled to the first member and hingedly coupled to the piston;

a third member wherein the first member is fixedly coupled to the third member and the third member is rotationally coupled to the cylinder wall thereby rotationally coupling the first member to the cylinder wall; and a fourth member oriented to extend in the longitudinal direction, the fourth member rotationally coupled with the first member to rotate the first member about the rotational axis substantially perpendicular to the longitudinal direction;

wherein the fourth member includes an end configured to be coupled with an electric drill.

* * * * *